United States Patent [19]

Vernon

[11] 4,007,551

[45] Feb. 15, 1977

[54] ORNAMENTAL GREETING CARD DISPLAY

[76] Inventor: Frank J. Vernon, 131 Central Ave., Bogota, N.J. 07603

[22] Filed: June 27, 1975

[21] Appl. No.: 591,082

[52] U.S. Cl. ..... 40/124.2

[51] Int. Cl.[2] ..... G09F 1/10

[58] Field of Search ..... 40/124, 124.2, 72; 35/73; 428/7, 10, 18, 19; D6/188

[56] References Cited

UNITED STATES PATENTS

| | | | |
|---|---|---|---|
| 2,740,218 | 4/1956 | Miller | 428/10 |
| 3,581,419 | 6/1971 | McCracken | 40/124 |

FOREIGN PATENTS OR APPLICATIONS

| | | | |
|---|---|---|---|
| 113,903 | 5/1918 | United Kingdom | 40/124 |

*Primary Examiner*—Hugh R. Chamblee
*Assistant Examiner*—John H. Wolff
*Attorney, Agent, or Firm*—Lackenbach, Lilling & Siegel

[57] ABSTRACT

A display device, for example in the shape of a Christmas wreath, is described which is suitable for mounting greeting cards each having a dimension at least equal to a predetermined value. The display device includes a support member having a substantially flat surface and an outer peripheral edge, including lateral inclined edges, which bound the surface. A plurality of elongate, substantially parallel horizontal mounting strips are spaced from each other, the spacing between the adjacent strips being equal to the predetermined value. Each of the strips is connected on the support member at only one elongate edge thereof to form an opening in the nature of a card-receiving pocket between the other elongate edge of the respective strip and the support member. The openings of all the strips face the upward direction and the strips have the opposing ends thereof each extending proximate to the peripheral edge to permit insertion of the greeting cards at the opposite ends of the card-receiving pockets with portions of the greeting card extending beyond the lateral inclined edges. A pre-tied bow member advantageously mounted on the support mmember for covering the lowermost strip. In this manner, insertion of the greeting cards in overlapping relation into all of the pockets formed by the strips, along the entire lengths and slightly beyond the ends thereof, totally covers the strips and support member from view and renders a display of greeting cards which generally assumes the shape of the support member.

8 Claims, 13 Drawing Figures

FIG. 8
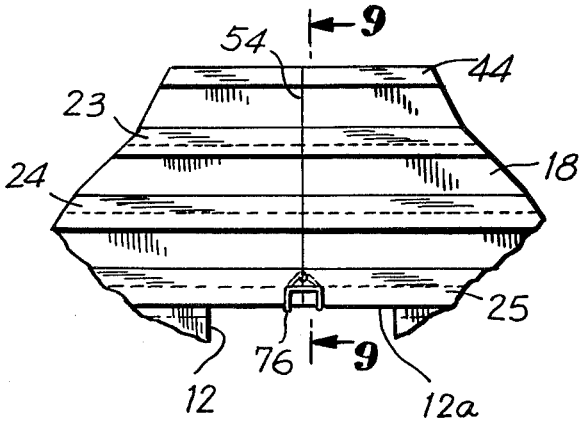
FIG. 10
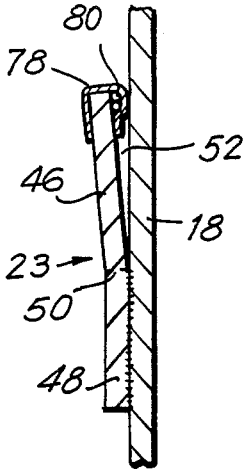
FIG. 11
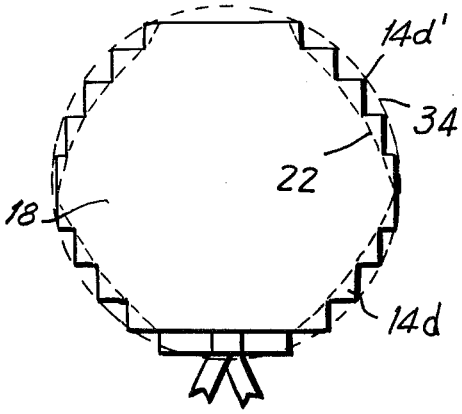
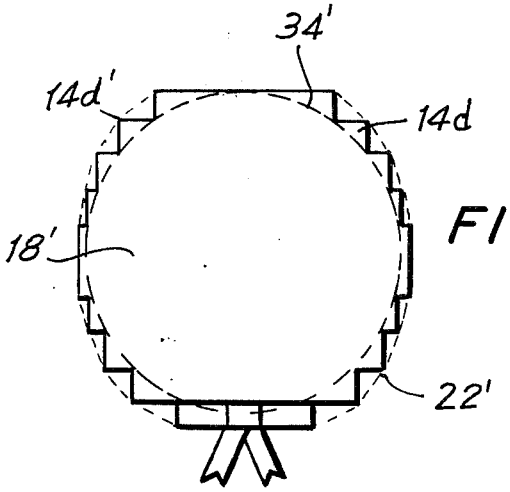
FIG. 12
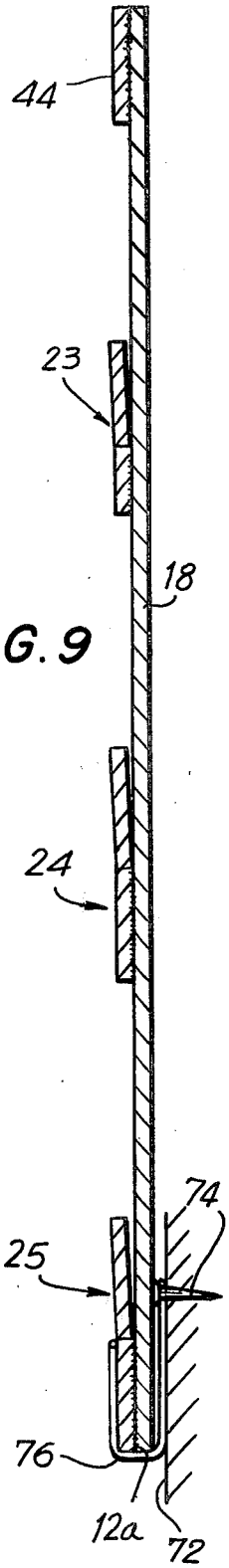
FIG. 9

ORNAMENTAL GREETING CARD DISPLAY

REFERENCE TO RELATED DISCLOSURE DOCUMENT

The subject matter of this application is related to that disclosed in Disclosure Document No. 030508, filed on Apr. 5, 1974.

BACKGROUND OF THE INVENTION

The present invention relates to ornamental and decorative displays, and more specifically to a display device for mounting greeting cards in such a manner that the supporting structure is totally covered by the greeting cards and concealed from view.

Numerous card holders and display devices are known. Most of these are memorandum devices which are intended to facilitate the display of reminder notices in an effective manner. Card holders of this type are shown in U.S. Pat. No. 71,878, and U.S. Pat. No. 1,408,469. Other types of card holders are used for educational purposes, these being adapted to support word and phrase cards. An example of this type of holder is shown in U.S. Pat. No. 1,790,287.

The prior art display devices of the above type are primarily concerned with the conveyance of information. The appearance of the overall display is a secondary consideration in most instances. While the prior art display devices make provision for supporting notices or cards, the prior art structures are not totally concealed from view by the cards which they support. Even the prior art display devices which are intended to support greeting cards, such as the decorative door-hung tree structure for holding greeting cards shown in U.S. Pat. No. 3,581,419, do not make provision for being fully concealed from view once all the greeting cards have been mounted. Additional patents which disclose display devices for greeting cards are U.S. Pat. Nos. 2,503,359 and 2,951,303.

Many of the prior art card holders, being typically intended for continual home or office use, are not in the nature of novelty devices. Additionally, these cardholders are generally complex in construction and therefore costly to manufacture.

SUMMARY OF THE INVENTION

Accordingly, it is an object of the invention to provide a display device which does not present the above-mentioned disadvantages inherent in the prior art devices.

It is another object of the present invention to provide a display device which is simple in construction and inexpensive to manufacture.

It yet another object of the present invention to provide a display device for mounting greeting cards to achieve a holiday mood or the spirit of an occasion in an easy, convenient manner, and not requiring special artistic, mechanical or physical abilities on the part of the user.

It is still an additional object of the present invention to provide a device that promotes the use of home readily available materials, i.e. christmas cards, that are normally discarded after receipt to thereby offer a most inexpensive way to decorate for the holiday or event being celebrated.

It is a further object of the invention to provide a device that encourages personal creativity, requiring the user to contribute to creating the finished decoration, as opposed to a completely manufactured, store-bought product, and as such having educational and entertaining value.

It is still a further object of the present invention to provide a device which when fully assembled and covered with greeting cards is universally appropriate for display anywhere, including private homes as well as public places and the like.

It is yet a further object of the present invention to provide a greeting card display device which is capable of being used and reused year after year, and that is easily stored between uses.

It is an additional object of the present invention to provide a greeting card display device which can take many forms or shapes to correspond with the holiday or event associated with the theme of the greeting cards.

It is yet an additional object of the present invention to provide a greeting card display device which is so constructed that it becomes totally concealed from view when cards are mounted onto it in accordance with a suitable arrangement, thereby producing a unique and especially aesthetic display of cards that take on the appearance or the outline of the underlying display device or support member.

In order to achieve the above object, as well as others which will become apparent hereafter, a display device in accordance with the present invention for mounting greeting cards, each having a dimension at least equal to a predetermined value, comprises a support member having a substantially flat surface and an outer peripheral edge bounding said surface. A plurality of elongate substantially parallel mounting strips are provided along one planar direction of said surface with said strips being oriented in horizontal directions when the device is mounted for use. The spacing between adjacent strips is equal to a predetermined value. Each of said strips is connected on said support member at only one elongate edge thereof to form an opening in the nature of a card-receiving pocket between the other elongate edge of the respective strip and said support member. The openings of all said strips face the same direction along said planar direction. Said strips have opposing ends thereof each extending approximate to said peripheral edge to thereby permit insertion of greeting cards in overlapping relation into all of said pockets formed by said strips along the entire length thereof to cover said support member and said strips above the lowermost strip from view. Decorative covering means may be provided and mounted on said support member for covering the lowermost strip, whereby said support member and all said strips are totally hidden from view and said display device is covered with an array of greeting cards which generally assumes the shape of said support member. When said outer peripheral edge includes lateral inclined edges, the present invention permits insertion of greeting cards at the opposing ends of the card-receiving pockets with portions of the greeting cards extending beyond said lateral inclined edges to thereby render a display of greeting cards which generally assumes a slightly modified shape from that of said support member.

With the above and other objects in view, the present invention will now be described in terms of a presently preferred embodiment, illustrated in the accompanying drawings, it being understood that minor variations or changes in form, proportions, and minor details of construction, are intended to fall within the scope and spirit of the present invention.

BRIEF DESCRIPTION OF THE DRAWINGS

FIG. 8 is a fragmented front elevational view of the upper portion of the support member, illustrating an alternate means for mounting the support member on a wall by the use of a wire hook instead of the hanging string loop shown in FIGS. 1–2;

FIG. 9 is an enlarged sectional view of the support member shown in FIG. 8, taken along line 9—9;

FIG. 10 is a fragmented cross-sectional view of the support member shown in FIG. 1A and similar to FIG. 3, showing optional means for finishing the upper edges of the strips;

FIG. 11 is a graphical representation of the support member as shown in FIG. 1A, and the manner in which the mounted greeting cards result in a desired substantially circular, wreath-shaped display; and FIG. 12 is a graphical representation similar to that in FIG. 11, but showing a circular support member and the manner in which the mounted cards result in a distorted or "squared" outline.

DESCRIPTION OF THE PREFERRED EMBODIMENTS

Figure 1:
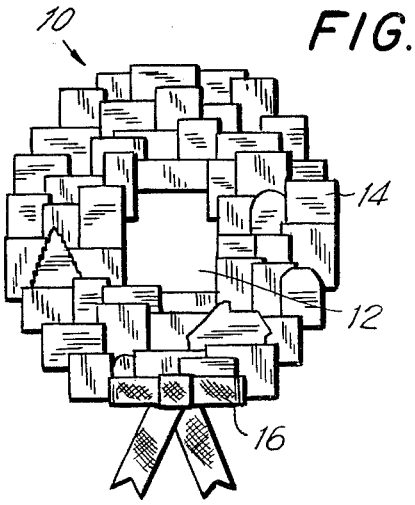
FIG. 1 is a side elevational view of a presently preferred embodiment of the present invention, shown when the greeting cards are mounted in a manner to fully cover the support member and thereby conceal the same from view.

Referring now specifically to the drawings, in which the identical or similar part designated by the same reference numerals throughout, and first referring to FIG. 1, there is shown a completed card display 10 in accordance with a presently preferred embodiment of the invention. The completed display 10 is in the shape of a christmas wreath and, accordingly, has a generally circular outer peripheral edge and a central opening 12 defining an inner peripheral edge. The completed display 10 includes an array of greeting cards 14 which contribute to the formation of the desired shape, as will be more fully described hereafter. A decorative covering means, such as a pre-tied bow 16, is advantageously included on the lower portion of the completed display 10, for reasons which will become apparent hereafter.

While the presently preferred embodiment to be described is in the shape of a christmas wreath, it will become evident that the principles of the present invention can also be applied to other shaped displays. More specifically, the shape of the completed display can correspond to those shapes most frequently associated with particular holidays or events. In the same manner as the wreath-shaped display may include christmas cards or the like, a heart-shaped display may include valentine cards, birthday numeral-shaped displays for birthday cards, bouquet-shaped displays for get-well cards and the like.

Figure 2:
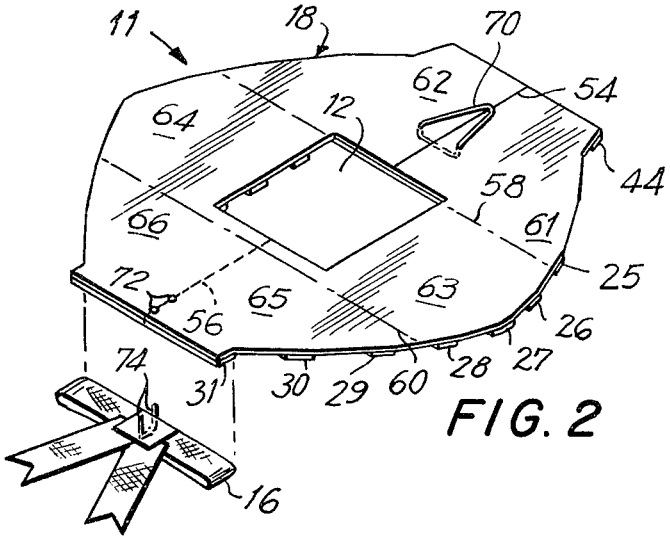
FIG. 2 is a perspective view of the rear side of the support member shown in FIG. 1A, further showing the pre-tied bow which covers the lowermost strip of the device prior to mounting of the bow on the support member.
Figure 1A:
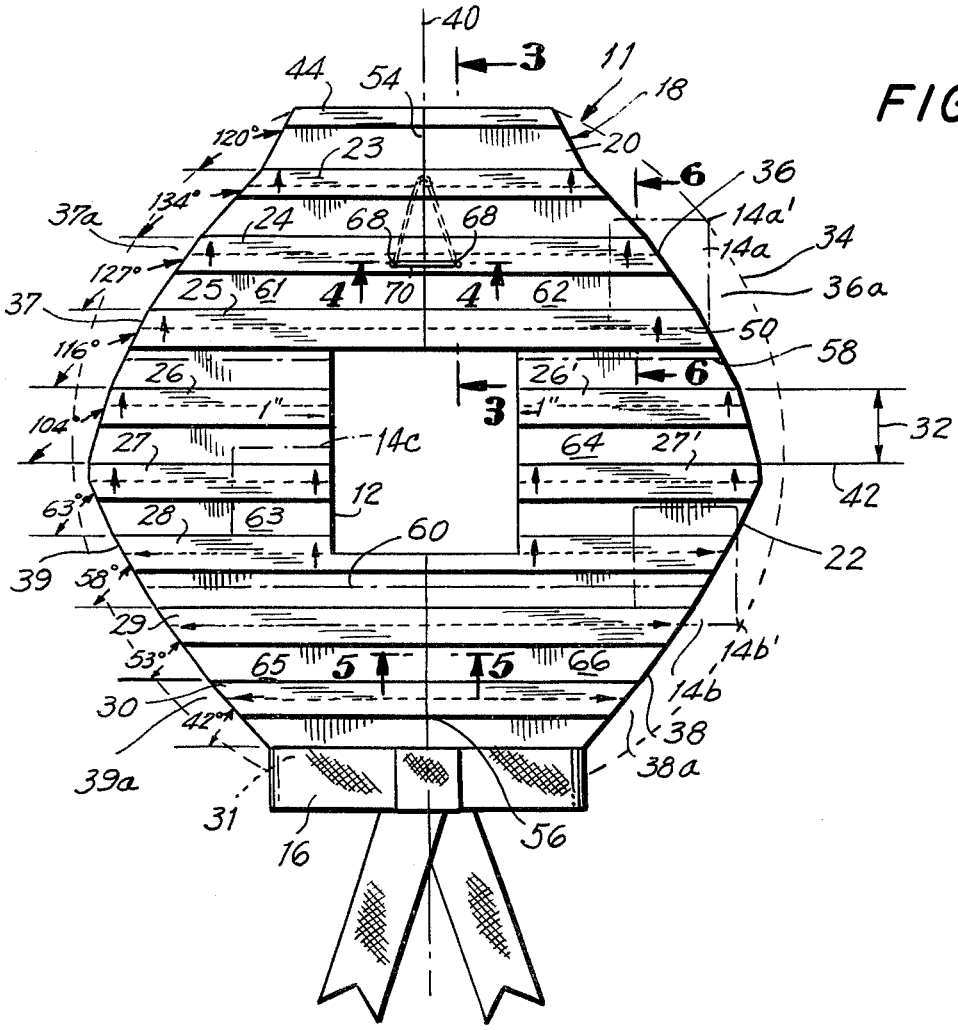
FIG. 1A is an enlarged front elevational view of the display device shown in FIG. 1 with the greeting cards removed and showing some of the details of construction.

Referring to FIGS. 1A and 2, a display device 11 comprises a support member 18 which has a front, substantially flat surface 20. The surface 20 has an outer peripheral edge 22, to be more fully described.

Mounted on the surface 18 are a plurality of parallel spaced strips 23–31, the lowermost strip 31 being concealed by the bow 16 in FIG. 1A. When the display device 11 is mounted for use, the strips assume horizontal positions as shown in FIG. 1A and extend between at least one of the inner and outer peripheral edges.

The spacing 32 between the upper edges of the strips is selected as a function of the size cards which are to be mounted. Once the distance or spacing 32 has been determined, it will become apparent that to fully cover the support member 18 the cards to be mounted must have at least one dimension equal to or greater than the distance 32. It has been determined that the distance 32 of approximately 4 inches is satisfactory for most standard sized greeting cards.

The number of strips and their lengths determine the overall size of the display device and, clearly, this can be modified to make the display as small or as large as desired. It has been found that an effective size for general use, including home, office or commercial establishments, is a display which has an overall length of approximately 36 inches and a width of approximately 36 inches. To achieve this size display, the strips 23–25 measure approximately as follows: strips 23–25 and 28–31 measure 16.75, 24, 30, 33, 28.25, 22.25 and 14.5 inches respectively. The strips 26 and 26' each measure 12 inches while the strips 27 and 27' each measure 13 inches. The opening 12 is 10 inches wide and 11 inches high. A stiffening strip 44 is advantageously provided and is 14 inches long.

Referring to FIG. 1A, there is shown a dashed circular periphery or outline 34 which substantially encloses the support member 18. The circular outline 34 illustrates how the peripheral edge 22 deviates from a circular outline by the provision of lateral inclined edges 36–39 which are in the nature of chords of the circular outline 34. In effect, the peripheral edge 22 may be formed by removing from a circular support member, segment-like portions **36*a*–39*a* to form a "modified" circular outline as shown and defined by the peripheral edge 22. While the inclined edges 36–39** are composed of straight or linear portions having the angles shown, this is clearly not critical and the edges may be continuous or smooth.

Referring to FIG. 11, the support member 18 of FIG. 1A having the above described outline or shape 22 is shown fully covered with greeting cards **14*d* in accordance with a procedure to be described below. It will be noted that the outer corners 14*d*' extending beyond the support member 18 together define or fall on a circular outline 34. On the other hand, when the cards are mounted in accordance with the same procedure on a support member 18' having a circular outline 34', as shown in FIG. 12, the corners 14***d'* together define a squared outline 22' which does not faithfully reproduce the desired circular shape. Accordingly, in order to produce a completed card display having a desired outline, the underlying support member must be made to deviate from the desired outline by providing, for example, lateral inclined edges 36–39 as suggested above. To form a circular outline, therefore, a modified circular outline or periphery 22 must be used.

With the display device 11 having a vertical axis 40 and a horizontal axis 42, the upper segments 36*a* and 37*a* are substantially mirror images of the lower segments 38*a* and 39*a* with respect to the horizontal axis 42. Similarly, the left hand segments 37*a* and 39*a* are substantially mirror images of the righthand segments 36*a* and 38*a* about the vertical axis 40.

Figure 3:
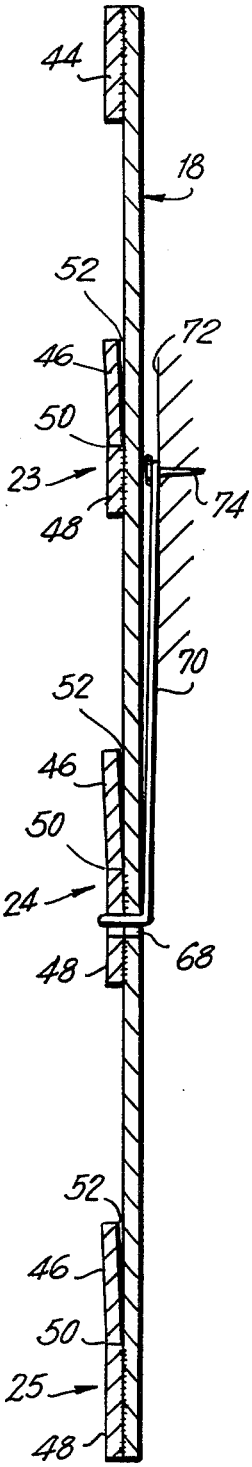
FIG. 3 is a sectional view taken along line 3—3 of FIG. 1A.
Figure 4:
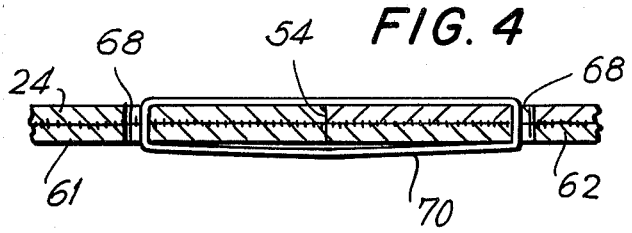
FIG. 4 is a fragmented cross-sectional view of the support member shown in FIG. 1A, taken along line 4—4.
Figure 6:
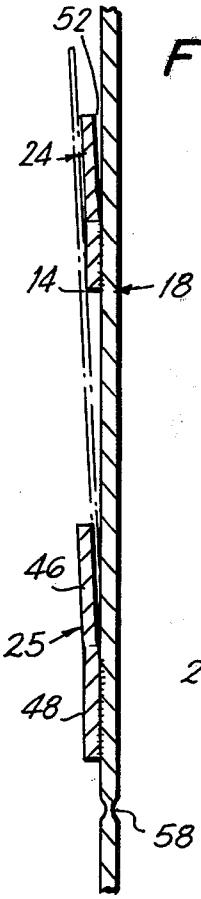
FIG. 6 is a fragmented cross-sectional view of the support member shown in FIG. 1A, taken along line 6—6.
Figure 7:
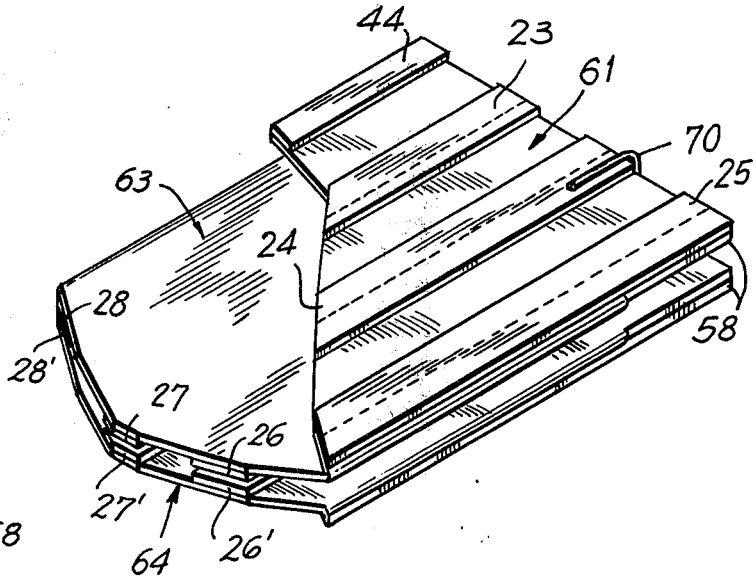
FIG. 7 is a perspective view of the display device support member shown in FIG. 1A, in the collapsed condition of the support member.

Further referring to FIG. 3, each of the strips 23–31 has an upper free, movable portion 46 and a lower portion 48 which is connected or joined to the support member 18 by any conventional means, such as adhesive, staples and the like to provide at least partially open end edges of the strips, as best shown in FIGS. 1A, 6 and 7, to permit greeting cards to be received within the resulting pockets and to extend beyond the ends of the strips and the peripheral edges, as to be more fully described hereafter. Advantageously, the strips are made from a flexible material, such as corrugated cardboard, and have a uniform width or height along the entire lengths thereof. When the spacing 32 is selected to be approximately 4 inches, the strips may be, for example, approximately 2 inches wide or high. When the upper portions 46 are too narrow or when the material from which the strips are made is not sufficiently flexible, the strips may be provided with score lines 50 parallel to the edges of the strips for facilitating movement of the support portions 46 away from the support member 18 to provide access to the card-receiving pockets 52 formed by the portions 46 and the support member 18. As best shown in FIG. 6, the lower edge of a card 14 is inserted behind a strip and retained by the upper removable portion 46 due to the resilient nature of the material and the tendency of the upper portions 46 to return to its initial position proximate the support member 18. The cards 14 project upwardly and cover that strip which is directly above the strip which retains the card. Since there is no strip directly below the central portion of the strip 25 (directly above the opening 12), cards 14 cannot be mounted on the display device 11 to project upwardly and cover the central portion of the strip 25. To cover the central portion of the strip 25, the following procedure can be used. One or two (as needed) horizontally folded cards are cut to take off an inch off the bottom of the back flap of the card and inserting only the back flap behind the strip, allowing the front cover of the card to hang over the strip 25. It should be clear that this same approach may be used to cover the bottommost strip 31 in place of using the bow 16. Other approaches and decorative means may similarly be used to conceal the lower portions of the display device 18.

The method of inserting or mounting cards on the support member 18 which provides the desired effect will now be described, with reference to FIG. 1A. Firstly, each of the strips is advantageously marked at the ends thereof with arrows as shown. Cards are inserted or wedged behind the stripping in an upright position and, as mentioned above, the cards must be sufficiently large so that when inserted they will cover the strip above.

While not critical, the initial cards are advantageously inserted at the ends of the holder strips and are inserted from the top strips towards the bottom. When inserting the cards, a most pleasing effect is obtained when adjacent cards are varied in color and size to produce a more colorful, artistically pleasing effect. With respect to the strips 23–28 which are marked with an upwardly directed arrow at the ends thereof, the cards are inserted to the very edge of the form so that the lower corners coincide with either the outer peripheral edge 22, or the side edges of the opening 12 respectively, as shown. At the inside ends of the strips 26 and 26', marked with inwardly directed arrows and the notation 1'', the cards are inserted to extend at least one inch beyond the lower ends of the strips 26 and 26'. Finally, with respect to the strips 28–31, marked with outwardly directed arrows, the cards are inserted to extend sufficiently beyond the end of the respective strip to cover the strip above, as suggested by the card 14*b* in FIG. 1A. After all the end cards have been inserted, the balance of the cards are inserted into the strips, advantageously starting with the top strip and working down to the bottom strip, filling each strip with cards completely before proceeding to the next row of strips. The cards mounted on the same strip should slightly overlap at their sides so that the strips as well as the support member 18 are fully covered or concealed from view.

It should be evident from the above procedure for mounting the cards that the cards mounted at the outer ends of the strips are mounted to permit portions of the greeting cards to extend beyond the lateral inclined edges 36–39, to varying degrees. In each case, the corners of the cards projecting furthest from the support member, such as corners 14*a'* and 14*b'*, are substantially positioned along the circular outline or periphery 34. The construction above described, namely the novel shape of the support member 18 and the arrangement of the strips which permits mounting of the cards as above described, results in both the pleasing or desired overall shape of the completed display 10, as well as provides the required retentive action of the strips upon the cards, particularly on the lower strips below the horizontal axis 42 which prevents the cards from falling off the display.

As suggested above, the support member 18 may be made from any suitable, preferably inexpensive material such as corrugated cardboard. The means to be presently described for collapsing the support member 18 is particularly suitable for use with materials such as cardboard. However, the necessary modifications for other materials will be readily apparent to those skilled in the art.

Figure 5:
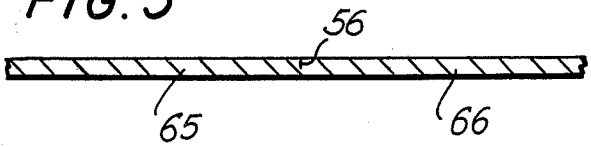
FIG. 5 is a fragmented cross-sectional view of the support member shown in FIG. 1A, taken along line 5—5.

The support member 18 is provided with an upper center cut 54 which extends through the thickness of the material and therefore permits separation of the two adjoining sections thus formed. The upper center cut 54 is made along the vertical axis 40 as is the lower center cut 56. However, the lower center cut 56 is only a front cut or a cut along the front surface of the support member 18, as shown in FIG. 5. Clearly, with the cuts 54 and 56 as described, the support member 18 may be folded about its vertical axis 40 to bring the two symmetrical halves back-to-back with the strips and front surface of the support member facing outwardly.

There are also provided a pair of vertical fold lines or weakened line portions 58 and 60, as shown in FIG. 1A. The fold lines 58 is just below the strip 25, while the fold line 60 is between the strips 28 and 29. The above arrangements of cut and fold lines generate a plurality of panels 61–66 as shown in FIG. 1A. In accordance with one presently preferred way of folding the support member 18, the lower portion of the support member is folded about the fold line 60 to bring the front faces of the panels 63 and 65, as well as the faces of the panels 64 and 66 into abutment against each other. Now, the upper portion of the support member is folded about the fold line 58 to bring the rear side or surfaces of the panels 61 and 63, as well as the panels 62 and 64 against each other respectively. Now, the folded support member is finally folded about the upper and lower center cuts to bring the rear surfaces of the panels 65 and 66 into abutment with each other and thereby separate the adjacent panels 61 and 62 as shown in FIG. 7. The specific arrangements of fold lines and cuts as well as the method of folding the support member 18 is not in and of itself critical and other methods and arrangements for performing this function may be used.

However, it should be clear that the collapsibility of the support member 18 makes it possible to utilize large displays while simultaneously permitting easy and convenient storage from year to year. Additionally, when folded as shown in FIG. 7, the device may be easily be inserted into a relatively small box for facilitating shipment.

Any suitable means may be used for hanging the display device 11 on a surface such as a wall. One presently preferred method is to provide punched holes 68 on opposite sides of the upper center cut 54 and passing a string or cord therethrough to form a closed loop 70. With such an arrangement, the support member 18 can easily be mounted on a wall surface 72, such as by means of a nail 74. The use of a loop 70 has the additional advantage that the tension forces in the string or loop 70 draw the adjacent sections toward each other to thereby maintain the opposing edges formed at the upper center cut 54 in abutment against each other.

An alternate means for hanging the support member 18 is shown in FIGS. 8 and 9, wherein a wire loop, which also acts as a spring clip snaps over the lower edge 12*a* of the opening 12 to maintain the adjacent sections at the upper center cut 54 together, and for providing a loop on the rear side of the support member for hanging on a nail 74. Other and numerous means may be used for hanging the support member 18, as will clearly become evident to those skilled in the art.

Being a novelty item, the display device 11 is advantageously manufactured in the least expensive manner. Accordingly, the strips are preferably simply cut from a corrugated cardboard sheet and left unfinished at the edges thereof. However, it is possible to modify the outer edges of the strips as shown in FIG. 10, wherein the outer edges are covered by a decorative material such as a colored tape 78. Additionally, packing or spacer means 80, which may be in the form of string may be used to slightly bend the strips and maintain the upper free movable portions 46 slightly spaced from the support member 18 to facilitate insertion of the greeting cards into the card-receiving pocket 52.

While the display device 11 may be made in different sizes and shapes, as suggested above, it has been found that a suitable size for a wreath as shown is approximately 36 inches in diameter and accepts approximately 45 greeting cards.

The display device 11 or a comparable device having a different outline or shape provides a simple and inexpensive way to make use of the greeting cards which are received to celebrate a holiday or occasion. The resulting or the completed display 10, with the cards mounted thereon, must of necessity be colorful and attractive, because most greeting cards themselves are bright and cheerful, and most of all, colorful. Once the greeting cards are mounted on the support member 18, the resulting display is both original and personal, no two can look exactly alike, and each year that the display device is used with different greeting cards, the display again takes on a different appearance. Aside from being decorative, the display device 11 is practical because it makes use of materials "on hand". For this reason, the display device is particularly appealing since it makes best use of existing materials instead of wasting these, and this is an important consideration in this age of ecology, recycling and waste cutting. Additionally, the display device 11, as well as differently shaped display devices made in accordance with the present invention have continued use since many of the holidays and events celebrated recur year after year, such as Christmas, Easter, birthdays and the like.

While there has been shown and described hereinbefore what is presently considered to be a presently preferred embodiment of the present invention, it will be apparent that various modifications and changes may be made without departing from the spirit of the invention or the scope of the following claims.

What is claimed is:

1. A display device for mounting greeting cards each having a dimension at least equal to a predetermined value, comprising a generally annularly or wreath-shaped support member having a substantially flat surface and outer and inner peripheral edges bounding said surface; a plurality of elongate substantially parallel mounting strips spaced along one planar direction of said surface said strips being oriented in horizontal directions when the device is mounted for use, the spacing between adjacent strips being equal to the predetermined value, each of said strips being connected on said support member at only one elongate edge thereof to form an opening in the nature of a card-receiving pocket between the other elongate edge of the respective strip and said support member, the openings of all said strips facing the same direction along said planar direction, said strips having the opposing ends thereof each extending to at least one of said peripheral edges, and being at least partially open at the end edges thereof to permit greeting cards to be received within the respective pockets and to extend beyond the ends of said strips and said peripheral edges, whereby insertion of greeting cards in overlapping relation into all said pockets formed by said strips along the entire lengths and beyond the ends thereof so as to project beyond said peripheral edges covers said support member and said strips above the lowermost strip; and decorative covering means mounted on said support member for covering the lowermost strip and that part of said support member not covered by the greeting cards, whereby said support member and all said strips are totally hidden from view and said display device is covered with an array of greeting cards which generally assumes the shape of said support member.

2. A display device as defined in claim 1, wherein said decorative covering means comprises a bow having dimensions sufficiently large to cover the lower portion of said support member and said lowermost strip.

3. A display device as defined in claim 1, wherein said support member is made of corrugated cardboard.

4. A display device as defined in claim 1, wherein said support member is provided with weakened line portions forming fold lines, whereby the display device can be collapsed from a generally flat extended condition to a folded condition to facilitate shipment and storage if the device is not in use.

5. A display device as defined in claim 1, further comprising mounting means associated with said support member for mounting the display device on a wall or the like.

6. A display device as defined in claim 1, wherein each of said strips is made from a flexible material and has a predetermined width, each strip having one portion thereof connected or joined to said support member over a fraction of said predetermined width above said one elongate edge, the remaining portion proximate to said other elongate edge being sufficiently flexible to permit movement away from said flat surface to provide access to said card receiving pocket.

7. A display device as defined in claim 1, wherein each of said strips is made from a flexible material, each strip having one portion thereof above said one elongate edge connected or joined to said support member, the remaining portion proximate to said other elongate edge being available for movement away from said flat surface to provide access to said card receiving pocket, each strip being provided with a score line substantially separating said portions of said strips and being parallel thereto, whereby said score lines facilitate access to said card receiving pocket by increasing the flexibility of said strips.

8. A display device for mounting greeting cards each having a dimension at least equal to a predetermined value, comprising a generally annularly or wreath-shaped support member having a substantially flat surface and an outer peripheral edge, formed by two pairs of opposing lateral inclined edges, and an inner peripheral edge bounding said surface; a plurality of elongate substantially parallel mounting strips spaced along one planar direction of said surface said strips being oriented in a horizontal direction when the device is mounted for display, the spacing between adjacent strips being equal to the predetermined value, each of said strips being connected on said support member at only one elongate edge thereof to form an opening in the nature of a card receiving pocket between the other elongate edge of the respective strip and said support member, the openings of all said strips facing the same direction along said planar direction, said strips having the opposing ends thereof each extending to at least one of said peripheral edges, and being at least partially open at the end edges thereof to permit greeting cards to be received within the respective pockets and to extend beyond the ends of said strips and said peripheral edges to permit insertion of greeting cards at the opposing ends of said card-receiving pockets with portions of the greeting cards extending beyond said lateral inclined edges and beyond said inner peripheral edge whereby insertion of greeting cards in overlapping relation into all said pockets formed by said strips along the entire lengths and slightly beyond the ends thereof covers said support member from view and renders a display of greeting cards which generally assumes a slightly modified shape of said support member.

* * * * *